United States Patent [19]

Luerken

[11] 4,028,740

[45] June 14, 1977

[54] CONVERTIBLE BEACH ATTIRE

[76] Inventor: Adolf Luerken, 26843 Grayslake Road, Palos Verdes, Calif. 90274

[22] Filed: Mar. 11, 1976

[21] Appl. No.: 666,075

[52] U.S. Cl. ..... 2/67

[51] Int. Cl.[2] ..... A41D 5/00

[58] Field of Search ..... 2/67, 48, 71, 73, 78 A, 2/212, 219, 235, 301, 319, 238; 24/163

[56] References Cited

UNITED STATES PATENTS

| | | | |
|---|---|---|---|
| 837,738 | 4/1906 | Schneider | 2/73 |
| 1,749,333 | 3/1930 | Fridolph | 2/73 |
| 1,851,826 | 3/1932 | Gardner | 2/73 X |
| 3,774,241 | 11/1973 | Zerkle | 2/403 |
| D165,506 | 12/1951 | Brenner | 2/42 |

FOREIGN PATENTS OR APPLICATIONS

| | | | |
|---|---|---|---|
| 16,506 | 8/1929 | Australia | 2/67 |

*Primary Examiner*—Werner H. Schroeder
*Assistant Examiner*—Doris L. Troutman
*Attorney, Agent, or Firm*—Henry M. Bissell

[57] ABSTRACT

The convertible beach attire of the invention is useful as swimming or sun-bathing attire. The invention comprises a pair of modesty panels of cloth or the like, and connector means attached to and/or forming part thereof and releasably connected to opposite sides of the panels to cause them to depend therefrom at the front and rear. The attire itself includes the bottom of a spring-type bikini, skimpy sunsuit or the like under the panels. The connector means may also include components which permit the panels to be affixed to the sides when not in use. The convertible beach attire is simple, attractive, inexpensive, highly functional and convenient.

10 Claims, 5 Drawing Figures

CONVERTIBLE BEACH ATTIRE

BACKGROUND OF THE INVENTION

1. Field of the Invention

The present invention generally relates to clothing and more particularly to clothing for use in water bathing, sun-bathing or the like when exposure of much of the body is desired.

2. Description of the Prior Art

Attire which is currently in fashion for swimming, sunbathing and the like is very skimpy and is becoming skimpier each year, leaving a larger and larger amount of the body exposed to the elements and to view. While present mores permit such scanty attire as string bikinis, mini bikinis and the like, on the beaches and in the water, even more daring boys, girls, men and women are still hesitant, due to public opinion, about going to and from the beaches clothed in such manner. Beach hotels, motels, apartment buildings and the like frequently require some modesty to attire. Yet blankets, robes and wraps resorted to by sun-bathers and swimmers in moving to and from beaches and the like so as to conceal their scanty attire are an admitted nuisance. Accordingly, there is a need for a simple, inexpensive, effective and convenient means of providing the desired temporary modesty covering for swimmers and sun-bathers to enable them to walk freely to and from beaches without public censure or comment.

SUMMARY OF THE INVENTION

The foregoing needs have been fully satisfied by the present invention. The convertible beach attire of the invention is substantially as set forth in the Abstract above. It comprises two flexible panels over bikini pants or the like and releaseably interconnected through connectors around the waist of the wearer. The panels may be suspended at the front and rear when passing to and from the beach, etc. The connectors are disposed at the wearer's sides so that when the panels are not needed, e.g. for swimming, sun-bathing, etc., they can be partially disconnected from the connectors in a way that allows them to depend from the sides of the body, out of the way and not obscuring the action of the body. If desired one or both panels can be totally removed from the connectors and later can be reconnected thereto when needed. Moreover, each panel can, if desired, be connected to the connectors in such a way that it is in a folded symmetrical and attractive position at the sides of the wearer. A partial beach attire may be composed of the discarded panels alone and can be used as the sole attire, when it is desired to skinny-dip or sun-bathe in the nude. It will be seen that the convertible beach attire is highly functional, easy to use, simple, convenient and appealing.

BRIEF DESCRIPTION OF THE DRAWING

A better understanding of the present invention may be had from a consideration of the following detailed description, taken in conjunction with the accompanying drawing, in which.

DESCRIPTION OF THE PREFERRED EMBODIMENTS

Figure 1:
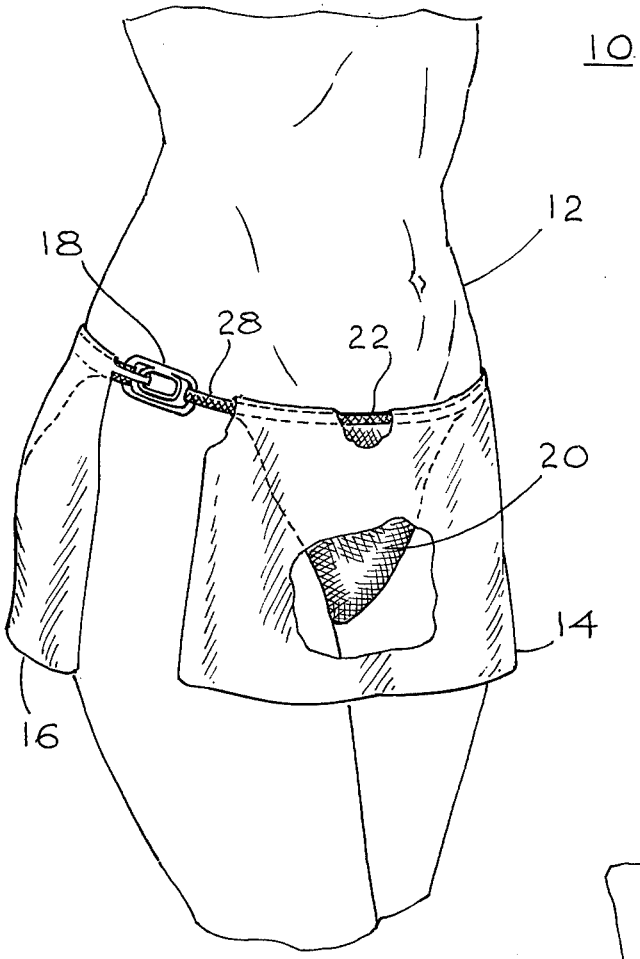
FIG. 1 is a schematic perspective view of one preferred embodiment of the convertible beach attire of the invention, portions being broken away to illustrate certain internal features.
Figure 2:
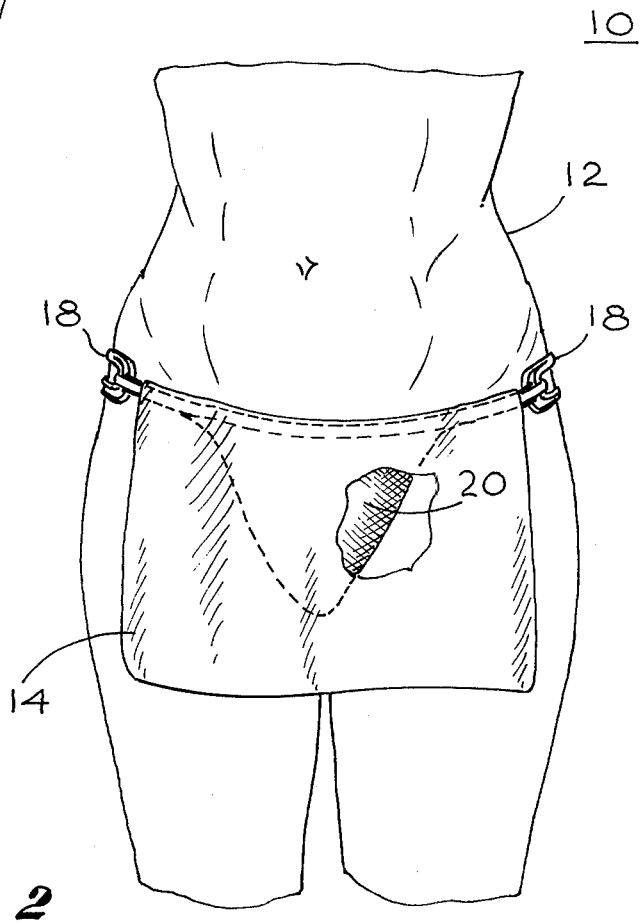
FIG. 2 is a schematic front elevation of the embodiment of FIG. 1, partly broken away to illustrate certain internal features.

Now referring particularly to FIGS. 1 and 2 of the accompanying drawings, novel convertible beach attire 10 is schematically shown displayed about the mid section 12 of a wearer. As shown, the attire 10 comprises a pair of generally rectangular, flexible panels 14 and 16, which may be of cloth, plastic or the like, connected around the waist of the wearer by a pair of connector means 18 disposed on opposite sides of the wearer's waist. Attire 10 also includes a bikini bottom 20 or such other swim or sun-bathing garment as may be appropriate for the purpose. The connector means 18 preferably are of corrosion-resistant metal or of plastic and serve a dual purpose in that they provide the fasteners to hold both the bikini bottom 20 and the panels 14 and 16 in place. In addition, as may be seen in FIG. 3, the connectors 18 provide a means for supporting a panel such as 14 in a stored position on one side of the wearer when it is not to be used to cover up portions of the body which are exposed by the bikini 20. The upper edge of the bikini is provided with a waistband or belt 22 having end ties, strings or straps 28 which are secured on opposite sides of the wearer to connectors 18.

Figure 3:
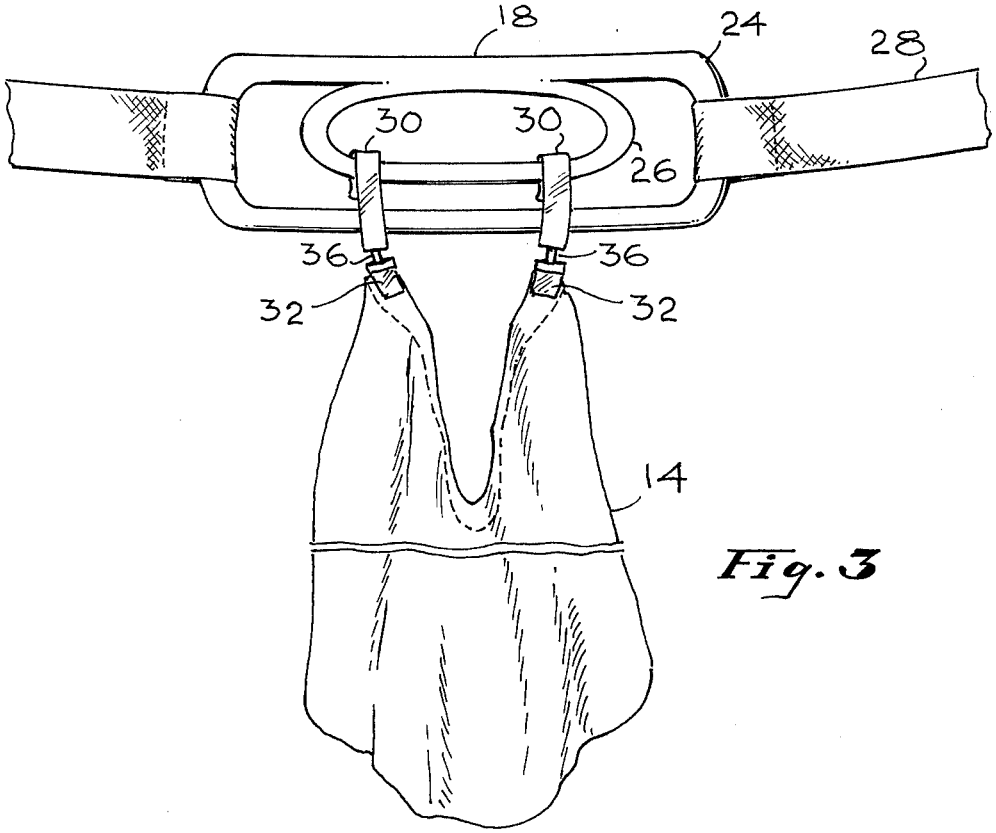
FIG. 3 is an enlarged schematic side elevation of a portion of the embodiment of FIG. 1, showing an optional mode of wear.

As is seen in further detail in FIG. 3, the connector means 18 includes an outer loop or ring 24 and an inner loop or ring 26. The bikini straps or strings 28 are secured at opposite ends of the ring 24 in conventional fashion as by ties, loops or the like. The inner ring 26, in the embodiment of FIG. 3, is joined to the outer ring 24 along an upper edge thereof and extends downward to a position of support for the panel 14, As shown in FIG. 3, the panel 14 is provided with a pair of releasable clips 30 for attaching to the ring 26. These clips 30 are affixed to opposite sides of the panel 14 at the upper corners thereof by fasteners 32, which may be releasable clamps or may simply be permanently stitched to the panel 14.

Panels 14 and 16 may be completely disconnected from the attire 10 by releasing the clips 30 from the rings 26 of connectors 18. However, one preferred way of moving panels 14, 16 to out-of-the-way positions (i.e., to shift from the configuration of FIGS. 1 and 2 to that of FIG. 3) is to merely disconnect only one clip 30 of each panel 14, 16, the clips 30 which are disconnected being diagonally opposite each other, so that as a result panel 14 hangs down from one side ring 26, being held there by one clip 30, as does panel 16 from the opposite side ring 26. Reconnecting the release clips 30 of the panels 14, 16 to the ring 26 of the connector 18 on the opposite side from that from which the panel was released develops the configuration shown in FIG. 3 in which the panel is supported in the stored position at the side of the wearer. In order to facilitate such repositioning of the panels 14, 16, it is desirable that the clips 30 be free to slide and pivot on the rings 26 from the generally horizontal alignment shown in FIG. 1 to a generally vertical depending alignment as in FIG. 3. The ring 26, being unobstructed along the bottom, facilitates such movement and, together with the releasable clips 30, admits of easy convertibility of the panels 14, 16 to permit a variety of color combinations—reversible inside to outside, reversible front to back, etc. Swivel members 36 may be provided in the form of strings or elastic for simplicity and ease of reversing the panels 14, 16. The members 36 may alternatively be pivotable swivels if desired.

Figure 4:
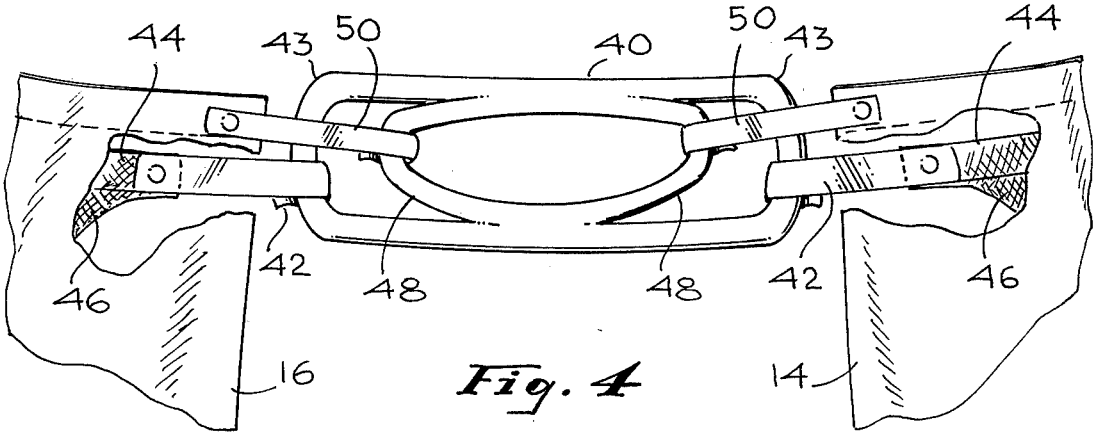
FIG. 4 is an enlarged schematic side elevation showing a variation of connector for use in the convertible beach attire of the invention.

As shown in FIG. 4, a slightly different form of connector means is provided. Here, a corrosion-resistant connector 40, used in the convertible beach attire of the invention, is provided with corrosion-resistant spring clip fasteners 42 releasably attached to outer ring portions 43 and secured, as by sewing, to the belt portion 44 of bikini underpants 46. The inner ring 48 of the connector 40 is secured to the outer ring 43 at both the upper and lower mid portions for added strength and support. Releasable clips 50, attached to panels 14, 16, support the latter from opposite end portions of the inner ring 48.

Figure 5:
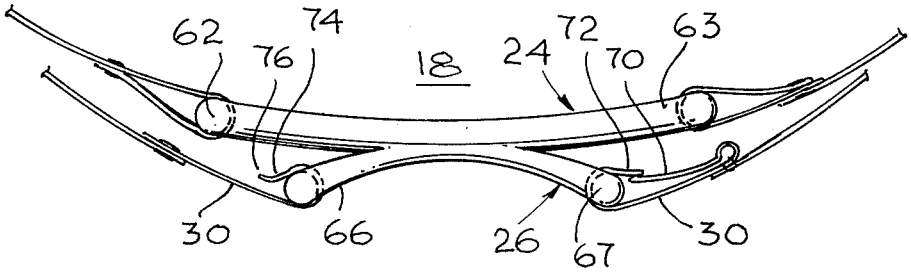
FIG. 5 is an edge view of a connector suitable for use in the embodiments of the present invention.

Particular details of a preferred connector means 18 are shown in FIG. 5. The connector 18 is typical of the embodiments shown and described hereinabove. FIG. 5 is a plan or edge view of the connector 18 which may preferably be molded of plastic or formed of some other corrosion-resistant material. As indicated in FIG. 5, the connector 18 comprises outer and inner rings 24 and 26 joined together at a mid-portion 60 with the ends spaced transversely of each other and lying in different vertical planes. The outer ring 24 has a pair of end loops 62, 63 to which corresponding thongs or other fastenings from the associated bikini or panty garment are secured. It will be noted that the outer ring 24 is configured with a slight concave curve to conform to the body in the region of contact. The inner ring 26 is shown with a pair of end loops 66 and 67 to which the clips 30 of the associated panels 14, 16 may be secured. The end loops 66, 67 of the inner ring 26 are configured to project outwardly away from the plane of the outer ring 24, thereby providing clearance from the wearer's body so that the clips 30 may be readily hooked and unhooked without risk of pinching or scratching the wearer.

As already described, when the modesty panels are to be removed from their operative position and placed in the stored position at opposite sides of the wearer's body, one of the clips 30 will be unhooked from its associated ring end member 66 or 67 and moved to the corresponding member of another connector 18 on the opposite side of the wearer's body. In this manner the two fasteners of a single panel, such as 14, will be secured on the same side from the end members 66, 67 of the inner ring 26, as shown in FIG. 3. In this way the modesty panels may be conveniently stored and at hand, available for transferring to their original position whenever there is need for their use.

In the arrangements shown in FIG. 5, the releasable clips 30 are shown in two somewhat different configurations. The right-hand clip 30 is a conventional snap safety link having a spring member 70 bearing against a hook end 72. This type of connector locks itself in position and can only be released by moving the free end of the spring member 70 away from the hook portion 72 so as to open the connector for release. The clip 30 shown in the left-hand side of FIG. 5 has its outer end 74 in the form of a resilient spring member with a leader 76 to open the spring member 74 as the clip is being pushed outwardly onto the end 66 of the inner ring 26. Pushing the clip 30 inwardly relative to the connector 18 serves to open the spring portion 74 sufficiently to release the clip 30 from the ring portion 66. Such a fastener may readily be fashioned of plastic or some similar resilient material.

Although there have been described above specific arrangements of convertible beach attire in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Convertible beach attire, which attire comprises, in combination:
   - a garment adapted to cover the lower portion of the human body;
   - means for encircling the waist of the human body and supporting the garment in position on the lower portion of the human body;
   - connector means attached at opposite sides to said encircling means, one connector means at each side of the waist; and
   - separate first and second flexible panels, each panel having at least two sides and each panel adapted to be releasably connected by its two sides to the connector means selectively at two sides of the waist and at one side of the waist.

2. The convertible beach attire of claim 1 further including clips attached to the upper end of each side of each said panel whereby, when one of said clips is disconnected from each said connector means, said panels depend from said connector means at one or both sides of said encircling means.

3. The convertible beach attire of claim 2 wherein said clips are pivotably connected to said panels.

4. The convertible beach attire of claim 1 further including pivotable and releasable fastener means secured to ends of the panels for convertibly supporting the panels in either of two attached configurations.

5. The convertible beach attire of claim 1 wherein said garment has a waistband which includes said encircling means.

6. The convertible beach attire of claim 5 wherein said connector means interconnect portions of said waistband and wherein said connector means include rings to which clips connected to the panels are pivotably connected.

7. The convertible beach attire of claim 5 wherein said garment comprises a bikini swim bottom and wherein said panels are of cloth.

8. The convertible beach attire of claim 1 wherein each connector means comprises first and second rings connected together at a common mid-portion, each ring having a pair of opposed end loops, the loops of the first ring being attached to respective portions of the encircling means, the loops of the second ring being disposed for releasable attachment to the panels.

9. The convertible beach attire of claim 8 wherein the loops of the second ring project outwardly of the plane of the first ring to facilitate releasable attachment thereto.

10. The convertible beach attire of claim 9 wherein the inner face of the rings at the common mid-portion is shaped concave inwardly to conform to the wearer's body.

* * * * *